United States Patent [19]

Schreurs

[11] 4,351,788

[45] Sep. 28, 1982

[54] METHOD FOR THE MANUFACTURE OF CLEAVING TILES

[75] Inventor: Gustaaf J. Schreurs, Tegelen, Netherlands

[73] Assignee: Mosa, B.V., Maastricht, Netherlands

[21] Appl. No.: 124,902

[22] Filed: Feb. 26, 1980

[30] Foreign Application Priority Data

Mar. 1, 1979 [NL] Netherlands ..... 7901625

[51] Int. Cl.[3] ..... B28B 11/00

[52] U.S. Cl. ..... 264/67; 264/148; 264/150; 264/151; 264/157

[58] Field of Search ..... 264/151, 67, 148, 150, 264/157

[56] References Cited

U.S. PATENT DOCUMENTS

| | | | |
|---|---|---|---|
| 1,477,663 | 12/1923 | Poston | 264/151 |
| 4,137,288 | 1/1979 | Lingl | 264/151 |
| 4,187,268 | 2/1980 | Sinnema | 264/151 |

*Primary Examiner*—James R. Hall

[57] ABSTRACT

A method for manufacturing cleaving split tiles from a continuous extrusion including forming a plurality of internal channels during extruding followed by the shaping of the corners and exterior surfaces of the extrusion and forming shaped vertical surfaces defining two of the tiles sides so that they blend with the other shaping of the extrusion with the formation of the vertical surfaces occurring so that the internal channels are not compressed. The extrusion is severed along a vertical groove formed when the vertical surfaces are formed with the severed portions being subsequently fired and thereafter split into tiles.

8 Claims, 7 Drawing Figures

METHOD FOR THE MANUFACTURE OF CLEAVING TILES

The invention relates to a method for the manufacture of cleaving or split from an extrusion of a ceramic mass in the form of a continuous column, from which moldings are cut the desired tile length. The moldings thus obtained are then dried, optionally glazed, and fired and subsequently cleft in a simple manner, so that each moulding yields two tiles. In the manufacture of such tiles by extrusion the column is provided in the middle with a row of longitudinal channels separated from each other by ceramic material so that after the moldings have been fired, cleavage along the longitudinal center plane of the molding can be effected with application of small forces.

The tiles thus obtained have straight edges so that when laid they form a mosaic of adjacent rectangles, squares or other configurations, with joints in between. Recently there has been increasing demand for variation in the field of tiles, not only as to color, printing and relief, but there is also a demand for tiles with rounded and sometimes undulating and/or irregular side edges which can be laid into a rustic large mosaic.

This can be realized by compression of the moist molding, after they have been cut from the column, to form smaller molding, in such a manner that rounded edges and, if so desired, also undulating edges are obtained.

The drawback of this method is that it is elaborate, time-consuming, additional waste material is produced.

The object of the invention is to provide a method of operation for the manufacture of a new type of cleaving or split tile with rounded and undulating and/or irregular side edges, which method is not elaborate and does not give uncontrolled dimensional fluctuations of the tiles without producing additional ceramic waste material.

According to the invention, this is achieved if the continuous extruded column upon leaving the extruder is passed between forming rollers which provide at least all the side edges of the extruded column with a relief. Both sides of the column are next provided with additional relief on those portions that will form the side edges of the exposed tile faces, this relief being formed at tile-length intervals and normal to the transport direction. This additional relief is formed by means of impression instruments, and the column is also served at the place of this additional impressed relief. As described above, the relief or pattern consists of rounded, undulating and/or irregular side edges of the tile.

The impressing of the additional relief and the cutting-off of the extruded column at the desired tile length are preferably effected at intervals which are equal to n times the desired wet-tile length, n being an integral number, preferably unity. It is difficult to first sever the column of ceramic material at tile length and then deform the side edges of what will be the exposed faces of the tiles in order to obtain a relief, since the supporting surface of the wet tiles, standing on end, is too small, which leads to some sagging of the tile so that subsequent application of the relief entails uncontrolled dimensional variations.

As stated above, the ceramic extruded column is provided along the center of the column with channels running longitudinally through the column and separated from each other by ceramic material. In order to prevent these openings from being closed by compression at the place of the relief during application of the additional relief, the stroke of the impression instruments is limited by means of a stop. Should, however, the openings be closed by this compression force, a partial vacuum is formed inside the column, causing it to collapse, form cracks, or become deformed. It is, therefore, necessary to make sure that air has constant access to the inside of the column through these channels. If the channels become closed, this would also cause problems during cleaving.

Cutting of the column, preferably while it is standing on one of its edges, may advantageously be done by means of one or more cutting devices, preferably by means of two parallel vertical wire cutters disposed on opposite sides of the column adjacent the exposed tile faces, the cutters can be moved synchronously towards each other until they through the thickness of the column from the outside to the inside. The actuation of the wire cutters for cutting of the column at tile length and the actuation of the impression instruments are preferably synchronized. This can be achieved, for instance, by coordinating the actuation of the cutting instruments via a relay which operates the pressure cylinder of the impression instruments. Cutting off the wet tiles by means of a vertically cutting device, which may be hinged, as is done in the case of bricks, would cause such a great vertical force on the column that it would be deformed owing to the small supporting surface. In this manner severing is effected exactly at the place where the additional relief has been or will be applied.

The method according to the invention provides a continuous process for the manufacture of a new type of cleaving or split tile, the side edges of the exposed sides of which are provided with a rounded and/or irregular undulate relief, so that the tiles can be laid to form a large mosaic of a rustic design.

In order to obtain moldings of the correct constant tile length, it is desirable for the periodic movement of the cutting instruments to be coordinated with the speed at which the extruded column travels. Preferably, this is measured by means of a measuring tape. If, in addition, the actuation mechanisms of the cutting instruments and the impression instruments are controlled synchronously, the additional impressed relief will be applied at the correct place in the extruded column.

The forming rollers which provide all the side edges of the extruded column with a relief by impression of the rollers therein require no separate drive, but can be driven through the friction between the extruded column and the forming rollers. These forming rollers may operate fully independently of the impression instruments for application of the additional relief, and of the cutting instruments. The forming rollers are disposed between the extrusion opening of the extruder and the cutting instruments, preferably between the extruder nozzle and the impression instruments. These forming rollers may also be used to provide the tile surface with a relief.

With minor adjustments of the existing method for the manufacture of tiles, it can be made suitable for the manufacture of this new type of cleaving or split tile. So, the existing equipment can be essentially maintained. Moreover, the rate of production is not affected.

The invention also relates to the manufacture of cleaving tiles from a continuous column of ceramic material, consisting of forming rollers to provide the side edges of the column with a relief, impression instruments which locally provide the column with an additional relief at sides, and cutting instruments which sever the column at tile length at a distance of (n−1) x the wet-tile length from the impression instruments, n being an integral number, as well as actuation instruments for periodic movement of the cutting and impression instruments. A measuring device is also employed for measuring the length or the rate of travel of the column, specifically a measuring tape by means of which the actuation of the impression instruments and the cutting instruments is controlled.

With reference to the drawing, the invention will be elucidated, and in this drawing.

Figure 2:
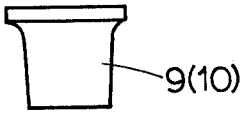
FIG. 2 is a lateral view of a side forming roller.
Figure 2A:
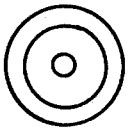
Figure 3:
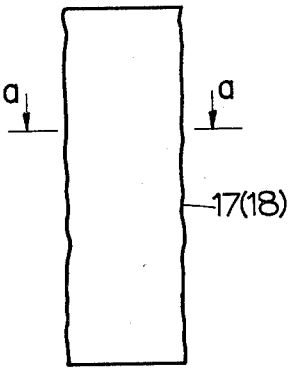
Figure 3A:
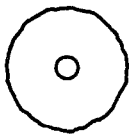
Figure 4:
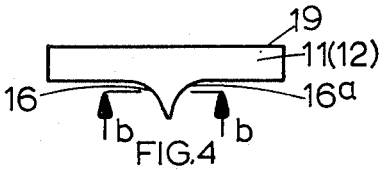
Figure 4A:
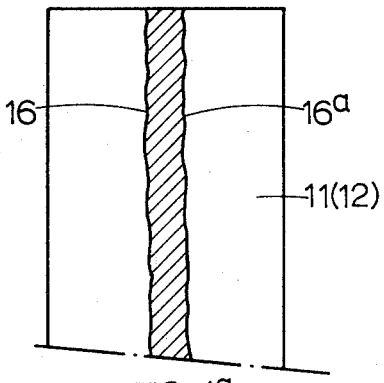

FIG. 2*a* is a top view of this side forming roller;

FIG. 3 is a side view of a relief roller;

FIG. 3*a* is a section along the line a—a in FIG. 3;

FIG. 4 is a top view of an impression instrument;

FIG. 4*a* is a section along the line b—b in FIG. 4.

Figure 1:
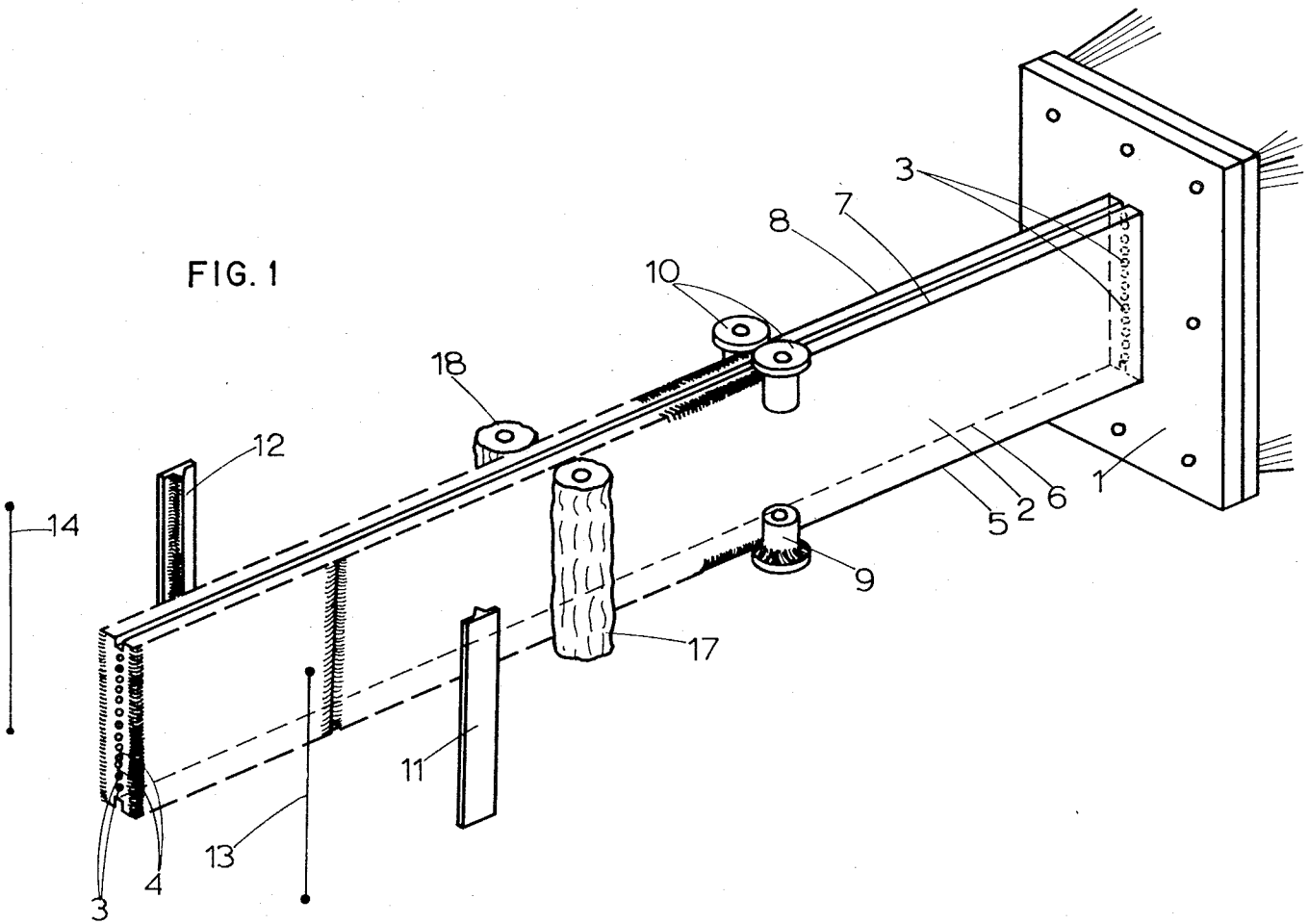
FIG. 1 is a perspective view of the device for implementation of the method according to the invention.

As FIG. 1 shows, a continuous column 2 of ceramic material is forced out of the column extruder 1, which column is provided with a row of channels in the longitudinal center plane, separated from each other by ceramic material 4. The extruded column 2, which has square or rounded side edges 5–8, is passed between forming rollers 9 and 10, which are so profiled that the side edges are provided with an irregular undulation and may be rounded. The rollers 9 and 10 are in such contact with the column 2 that they are driven through the friction between the extruded column and the rollers. In order to form the previously non-existing side edges of the tile so they are shaped with a rounded and undulate pattern, the impression instruments 11 and 12 apply a rounded and undulate additional relief on both sides of the column along its width, normal to the direction of travel and at tile-width intervals. At the place of such an additional relief, the wire cutters 13 and 14, which are moved periodically in opposing directions, cut moldings from the extruded column, which moldings can subsequently be dried, optionally glazed and fired and then cleft. In order to ensure that the extruded column is severed at the place where the additional relief has been applied by the impression instruments 11 and 12, the actuation devices (not shown) of the impression instruments 11 and 12 and of the wire cutters 13 and 14 are linked synchronically with each other. The cutting of the extruded column 2 at tile length and the applying of the additional pattern by the impression instruments 11 and 12 are effected independently of each other, at intervals equal to n times the tile width. Preferably, n is equal to 1. By the action of the impression instruments 11 and 12, the ceramic material may be slightly compressed. It has to be prevented that the channels 3 are closed by this compression, since otherwise a partial vacuum will be formed in the inside of the extruded column, causing the column to collapse, form cracks or be deformed, while, moreover, cleaving of the tiles may give rise to difficulties. To prevent closing of the channels by compression, the stroke of the impression instruments is limited by means of a stop (not shown).

FIG. 2 shows a side view of a side forming roller; FIG. 2*a* is a top view of the same. As shown in FIG. 2, roller 9 and roller 10 curve outwardly towards their end. FIG. 3 shows a relief roller in elevation. This figure, as well as FIG. 3*a*, which is a section along the line a—a in FIG. 3, shows that the circumference of this rollers 17 and 18, along the entire height thereof, is of undulate shape, for the purpose of application of a relief on what is to become the surface of the tile. FIG. 4 shows a top view of impression instruments 11 and 12. As appears from this figure, the side faces 16 and 16*a* of this instrument curve towards the rear side 19. FIG. 4*a* is a section along the line b—b in FIG. 4, clearly showing the irregularly undulate profile of the side faces 16 and 16*a* along the height of the impression instruments.

I claim:

1. A method for manufacturing cleaving tiles from a continuously extruded column of a ceramic material having exterior top, bottom and opposing pair of side walls comprising the steps of:

(a) extruding a column of a ceramic material while simultaneously forming a plurality of internal channels, through which air has constant access, each having an elongated axis extending parallel to the direction of movement of the extrusion through the length of the extrusion substantially half way between the pair of side walls;

(b) passing the extrusion through a first shaping station to shape the exterior edges defined by the top, bottom and opposing exterior side walls so that the exterior edges have a rounded, undulating surface;

(c) passing the extrusion through a second shaping station to form a compressed indentation on each side of the extrusion without compressing the plurality of internal channels thereby maintaining air therein, the indentation having parallel opposing rounded and undulating side edge portions terminating along a line substantially perpendicular to the direction of movement of the extrusion;

(d) severing the extrusion into individual segments along the line between the side edge portions formed according to step (c);

(e) firing the individual segments; and (f) cleaving the individual segments fired according to step (e) to form two separate tiles from each individual segment.

2. A method according to claim 1 wherein steps (c) and (d) are practiced independently of each other at predetermined intervals.

3. A method according to claim 1 wherein the formation of the compressed indentation in step (c) is practice by:

moving impression instruments into the column from each side of the column; and controlling the depth of insertion by means of a stop device.

4. A method according to claims 1, 2 or 3, further including prior to step (e), the step of placing the column on end.

5. A method according to claim 4 wherein step (d) is practiced by moving two, vertically positioned, parallel cutting devices on opposite sides of the column synchronously towards one another and into the column thereby severing the column.

6. A method according to claims 1, 2 or 3, wherein the column is severed across its thickness from the outside to the inside.

7. A method according to claims 1, 2 or 3, wherein steps (c) and (d) are performed synchronously.

8. A method according to claim 7 wherein step (d) is coordinated with the rate of movement of the column.

* * * * *